US008635952B2

(12) United States Patent
Izume

(10) Patent No.: US 8,635,952 B2
(45) Date of Patent: Jan. 28, 2014

(54) MACHINE PLATE FOR PRINTER AND PRINTER

(76) Inventor: Masayuki Izume, Kyoto (JP)

( * ) Notice: Subject to any disclaimer, the term of this patent is extended or adjusted under 35 U.S.C. 154(b) by 437 days.

(21) Appl. No.: 12/736,913

(22) PCT Filed: May 21, 2009

(86) PCT No.: PCT/JP2009/059311

§ 371 (c)(1),
(2), (4) Date: Nov. 22, 2010

(87) PCT Pub. No.: WO2009/145100

PCT Pub. Date: Dec. 3, 2009

(65) Prior Publication Data

US 2011/0061551 A1 Mar. 17, 2011

(30) Foreign Application Priority Data

May 27, 2008 (JP) ..... 2008 137766

(51) Int. Cl.
*B41F 27/00* (2006.01)
*B41F 5/00* (2006.01)

(52) U.S. Cl.
USPC ..... 101/382.1; 101/216; 101/375

(58) Field of Classification Search
USPC ..... 101/216, 375, 376, 382.1, 383
See application file for complete search history.

(56) References Cited

U.S. PATENT DOCUMENTS 3,639,959 A * 2/1972 Bagley et al. ..... 492/50
4,144,813 A * 3/1979 Julian ..... 101/382.1
4,951,568 A * 8/1990 Tsukamoto et al. ..... 101/415.1
5,535,674 A * 7/1996 Vrotacoe et al. ..... 101/216
5,687,647 A * 11/1997 Vrotacoe et al. ..... 101/375
5,711,222 A * 1/1998 Taylor et al. ..... 101/383
5,752,444 A * 5/1998 Lorig ..... 101/375
6,205,923 B1 * 3/2001 Dawley et al. ..... 101/382.1
6,394,943 B1 * 5/2002 Cormier et al. ..... 492/47
6,792,858 B2 * 9/2004 Kolbe et al. ..... 101/376

FOREIGN PATENT DOCUMENTS

EP 0306986 A2 3/1989
JP 5-11627 A 5/1993
JP 6-328657 A 11/1994
JP 2000-103036 A 4/2000
JP 2000-508983 A 7/2000

OTHER PUBLICATIONS

Supplementary European Search Report dated Jan. 20, 2012, issued for the corresponding European patent application No. 09754608.9.
International Search Report for International Application: PCT/JP20009/059311 issued Jun. 23, 2009.

* cited by examiner

*Primary Examiner* — Ren Yan
(74) *Attorney, Agent, or Firm* — Edwards Wildman Palmer LLP; James E. Armstrong, IV; George N. Chaclas

(57) ABSTRACT

The present invention provides a machine plate for a printer which can be readily and accurately attached to the printer. A machine plate 2 is characterized in that a rectangular sheet 19 of an elastic material is formed into a cylindrical shape with opposite end portions of the sheet 19 superposed on each other and joined together, thereby forming a cylindrical plate body 17; an end portion of the sheet 19 located on the inner side of a joint portion 20 is bent inward, thereby forming an engagement portion 21; and a form area 18 is provided at a predetermined portion of the outer circumferential surface of the machine-plate body 17 excluding the joint portion 20.

3 Claims, 5 Drawing Sheets

MACHINE PLATE FOR PRINTER AND PRINTER

TECHNICAL FIELD

The present invention relates to a machine plate for a printer (hereinafter may be referred to as a "printer machine plate"), and a printer.

BACKGROUND ART

There is known a printer in which a machine plate is mounted on the outer circumference of a machine-plate cylinder fixed on a machine-plate drive shaft.

SUMMARY OF THE INVENTION

Problems to be Solved by the Invention

In the above-mentioned printer, a sheet-like machine plate may be wound onto a machine-plate cylinder fixed on a machine-plate drive shaft. In such a case, mounting the machine plate within the printer is troublesome, and difficulty is encountered in accurately attaching the machine plate to the machine-plate cylinder.

In order to avoid such difficulty, the sheet-like machine plate may be wound onto the machine-plate cylinder while the machine-plate cylinder is detached from the machine-plate drive shaft, followed by fixation of the machine-plate cylinder on the machine-plate drive shaft. In this case, since the machine-plate cylinder is considerably heavy, difficulty is encountered in detaching and attaching the machine-plate cylinder from and to the machine-plate drive shaft.

An object of the present invention is to solve the above-mentioned problems and to provide a machine plate for a printer which can be readily and accurately attached to the printer, and a printer using the machine plate.

Means for Solving the Problems

A machine plate according to the present invention is characterized in that a rectangular sheet of an elastic material is formed into a cylindrical shape with opposite end portions of the sheet superposed on each other and joined together to form a joint portion whereby a cylindrical machine-plate body is formed; an end portion of the sheet located on the inner side of the joint portion is bent inward whereby an engagement portion is formed; and a forme area is provided at a predetermined portion of the outer circumferential surface of the machine-plate body excluding the joint portion.

Herein, the term "forme area" means an area where a forme is already formed (processed area), as well as an area where a forme is to be formed and is not yet formed (area to be processed).

The machine plate according to the present invention is mounted on a machine-plate mounting device of a printer for use thereof. For example, the machine-plate mounting device comprises a machine-plate cylinder section fixedly provided on a machine-plate drive shaft. The machine plate is fitted onto the machine-plate cylinder section from one end side thereof. The machine-plate cylinder section has, on its outer circumference, a groove for circumferential positioning into which the engagement portion of the machine plate is fitted from the one end side thereof; and a stopper for axial positioning with which an end portion of the machine plate comes into contact. In this case, the machine plate can be accurately and readily attached to the machine-plate cylinder section at a predetermined position. Further, the machine plate can be readily removed from the one end side of the machine-plate cylinder section.

In the machine plate of the present invention, preferably, the bending angle of the engagement portion is greater than 90 degrees.

The "bending angle" is an angle of actually bending the engagement portion from a state of the flat sheet. Therefore, the angle between the engagement portion and an adjacent portion of the sheet (sheet-engagement-portion angle) is a value obtained by subtracting the bending angle from 180 degrees.

When the bending angle of the engagement portion is rendered greater than 90 degrees, the sheet-engagement-portion angle becomes smaller than 90 degrees.

In this case, preferably, the machine-plate cylinder section is rotated in such a direction that the end portion of the sheet, which constitutes the machine-plate body, the end portion having the engagement portion, is located on the front side with respect to the rotational direction. By virtue of such rotation, the projecting end of the engagement portion faces rearward with respect to the rotational direction. Thus, as the machine-plate cylinder section rotates, the engagement portion bites into the groove, so that the position of the machine plate is free from deviation.

Preferably, the bending angle is 125 degrees to 145 degrees inclusive (the sheet-engagement-portion angle is 55 degrees to 35 degrees inclusive). Most preferably, the bending angle is 135 degrees (the sheet-engagement-portion angle is 45 degrees).

A printer according to the present invention is characterized by comprising a machine-plate mounting device on which a cylindrical machine plate is mounted. The machine plate is configured such that a rectangular sheet of an elastic material is formed into a cylindrical shape with opposite end portions of the sheet superposed on each other and joined together to form a joint portion whereby a cylindrical machine-plate body is formed; an end portion of the sheet located on the inner side of the joint portion is bent inward whereby an engagement portion is formed; and a forme area is provided at a predetermined portion of the outer circumferential surface of the machine-plate body excluding the joint portion. The machine-plate mounting device comprises a machine-plate cylinder section which is fixedly provided on a machine-plate drive shaft and has an outer circumference on which the machine plate is mounted from a front-end side of the machine-plate drive shaft, wherein the machine-plate cylinder section has, on the outer circumference, a groove for circumferential positioning into which the engagement portion of the machine plate is fitted from the front-end side of the machine-plate drive shaft, and a stopper for axial positioning with which an end portion of the machine plate comes into contact.

In the printer of the present invention, the machine plate is fitted onto the outer circumference of the machine-plate cylinder section from its one end portion such that the engagement portion of the machine plate fits into the groove of the machine-plate cylinder section, and the one end portion of the machine plate is brought into contact with the stopper, whereby the machine plate can be accurately and readily attached to the machine-plate cylinder section at a predetermined position.

In the printer of the present invention, for example, the machine-plate cylinder section has an air chamber which is formed within the machine-plate cylinder section and to which compressed air is supplied from air supply means; the outer diameter of a front end portion of the machine-plate cylinder section decreases toward the distal end thereof; and air discharge holes communicating with the air chamber are formed on the outer circumferential surface of the machine-plate cylinder section, including a portion having a decreased outer diameter, at a plurality of locations in the axial direction and the circumferential direction.

A portion of the machine-plate cylinder section on which the machine plate is mounted has an outer diameter slightly larger than an inner diameter of the machine plate, and the distalmost end of the machine-plate cylinder section has an outer diameter slightly smaller than the inner diameter of the machine plate.

When compressed air is supplied to the air chamber of the machine-plate cylinder section, the air flows outward from the air discharge holes on the outer circumferential surface. When the cylindrical machine plate is fitted onto the outer circumferential surface of the machine-plate cylinder section in such a state, the machine plate expands in the radial direction due to the pressure of the air discharged from the air discharge holes, whereby the inner diameter of the machine plate becomes larger than the outer diameter of the machine-plate cylinder section, and the machine plate can be readily fitted onto the outer circumference of the machine-plate cylinder section. When the supply of compressed air to the air chamber is then stopped, the machine plate contracts and comes into close contact with the outer circumferential surface of the machine-plate cylinder section, whereby the machine plate is fixed in a press-fitted state. When air is supplied to the air chamber of the machine-plate cylinder section and the air is caused to flow out of the discharge holes in a state where the machine plate is fixed to the machine-plate cylinder section, the machine plate expands in the radial direction due to the pressure of the air, whereby the inner diameter of the machine plate becomes larger than the outer diameter of the machine-plate cylinder section, and the machine plate can be readily removed from the machine-plate cylinder section.

As described above, through supply of compressed air to the air chamber of the machine-plate cylinder section, the machine plate can be accurately and readily fixed to the machine-plate cylinder section and can be readily removed from the machine-plate cylinder section.

In the above-described printer, for example, the bending angle of the engagement portion of the machine plate is greater than 90 degrees, and the machine-plate cylinder section is rotated in such a direction that the end portion of the sheet which constitutes the machine-plate body, the end portion having the engagement portion, is located on the front side with respect to the rotational direction.

In this case, the distal end of the engagement portion faces rearward with respect to the rotational direction. Therefore, when the machine-plate cylinder rotates, the engagement portion bites into the groove, so that the position of the machine plate is free from deviation.

Effect of the Invention

As mentioned above, according to the printer machine plate and the printer of the present invention, a cylindrical machine plate can be readily and accurately attached to a machine-plate cylinder section fixedly provided on a machine-plate drive shaft of the printer, and the cylindrical machine plate can be readily removed from the machine-plate cylinder section.

DESCRIPTION OF REFERENCE NUMERALS

Figure 1:
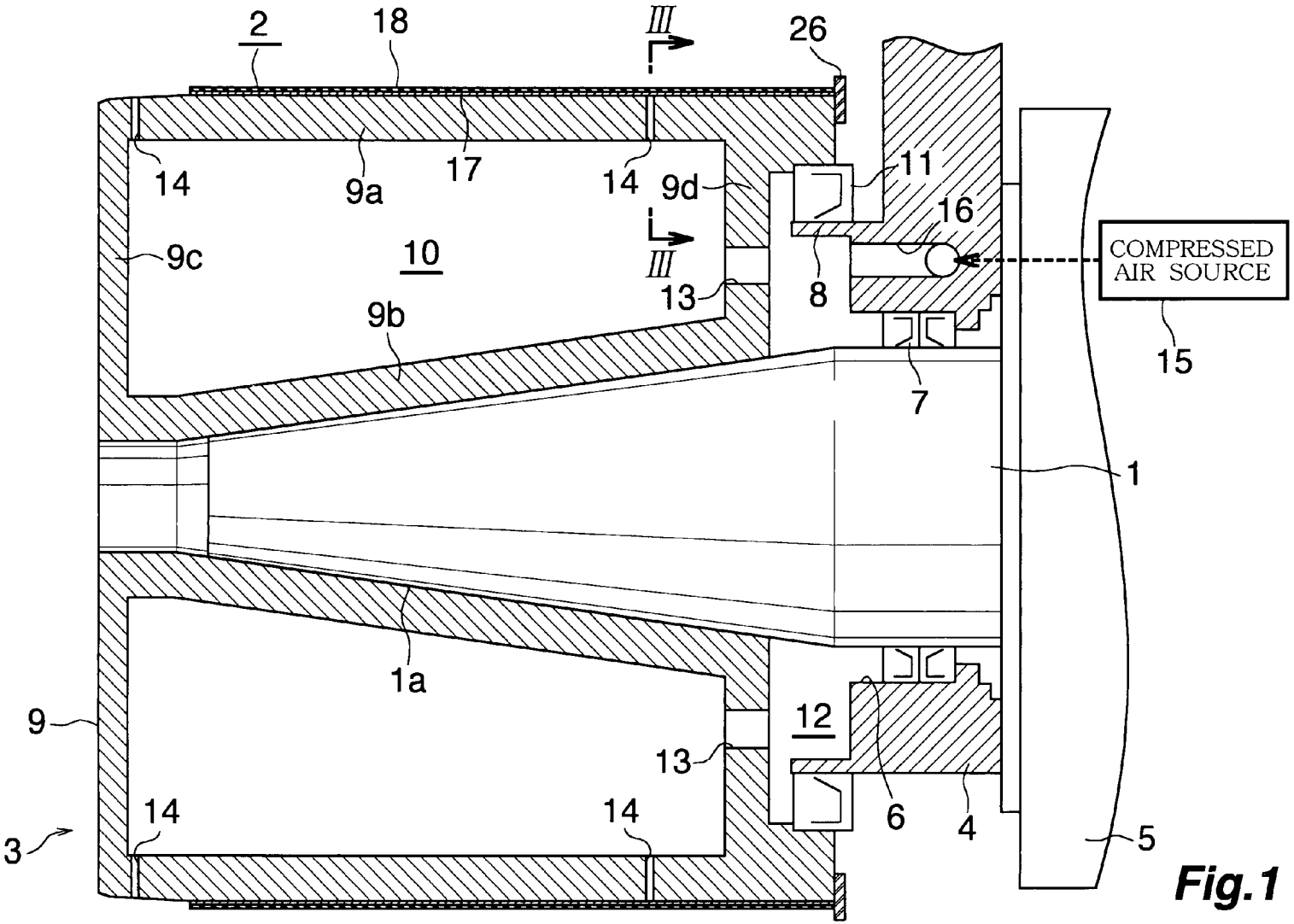
FIG. 1 is a vertical sectional view of a machine-plate mounting device of a printer according to an embodiment of the present invention.

1: machine-plate drive shaft
3: machine-plate mounting device
9: machine-plate cylinder section
10: air chamber
12: closed space
13: communication hole
14: air discharge hole
15: compressed air source
16: air passage
17: machine-plate body
18: forme area
19: sheet
20: joint portion
21: engagement portion
25: groove for circumferential positioning
26: stopper for axial positioning

MODES FOR CARRYING OUT THE INVENTION

An embodiment of the present invention will next be described with reference to the drawings.

Figure 2:
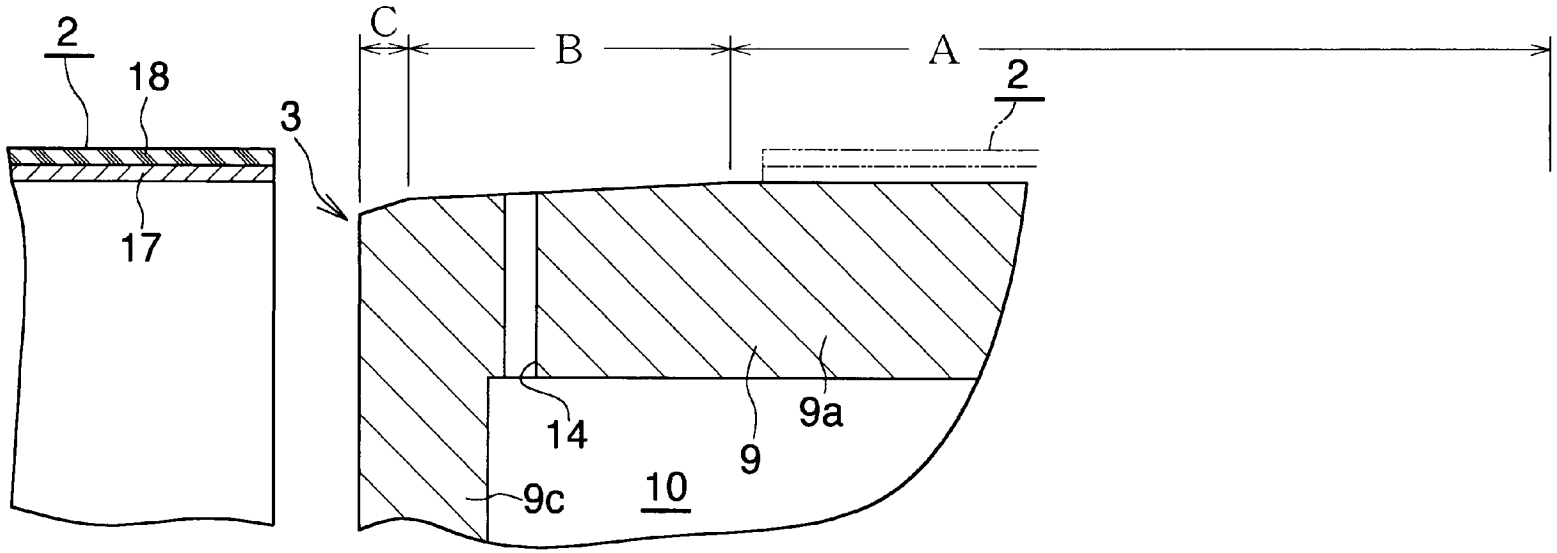
FIG. 2 is a vertical sectional view showing, on an enlarged scale, a portion of the machine-plate mounting device and a portion of a machine plate before being attached thereto.
Figure 3:
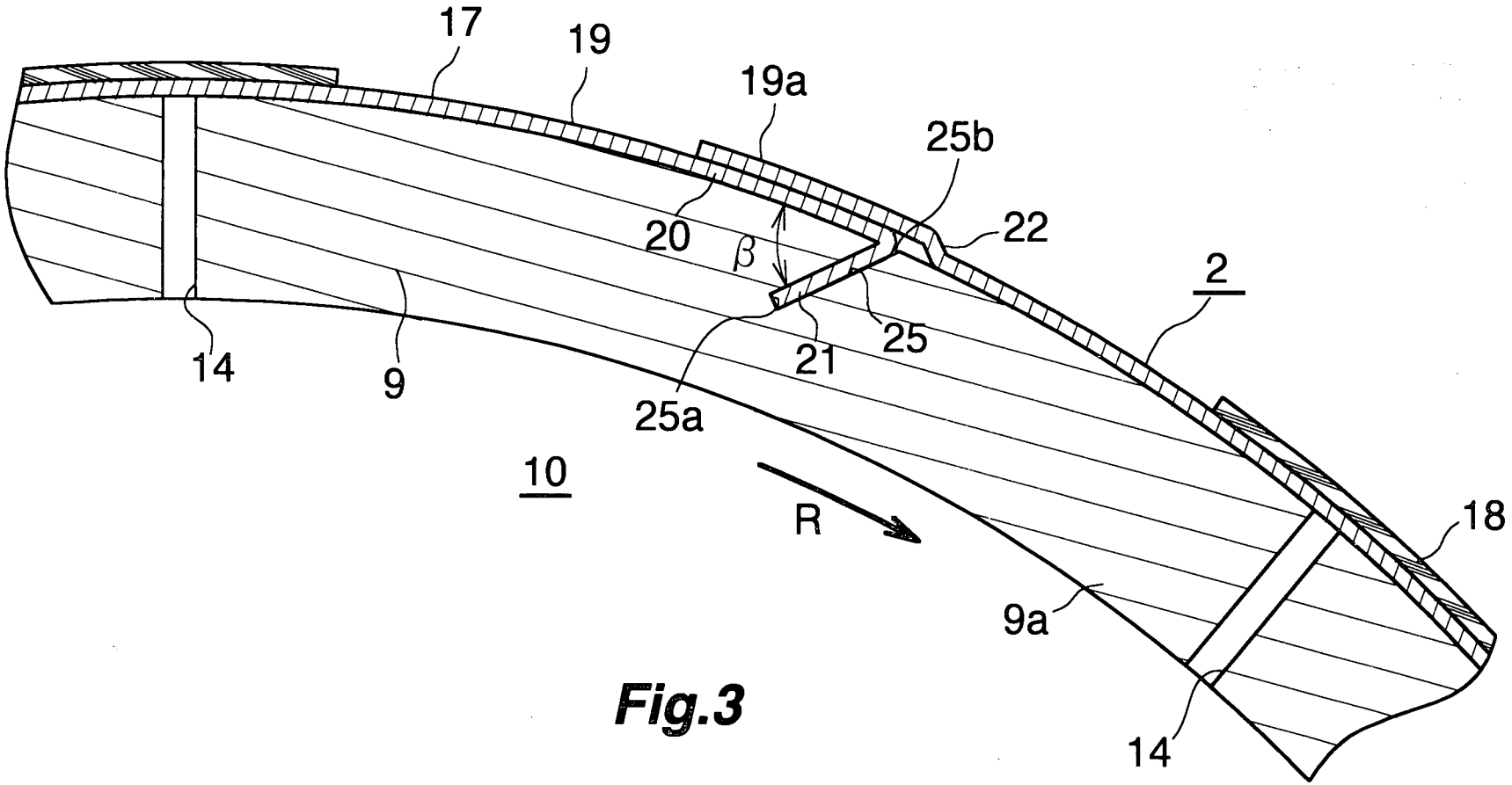
FIG. 3 is a sectional view taken along line III-III of FIG. 1.
Figure 4:
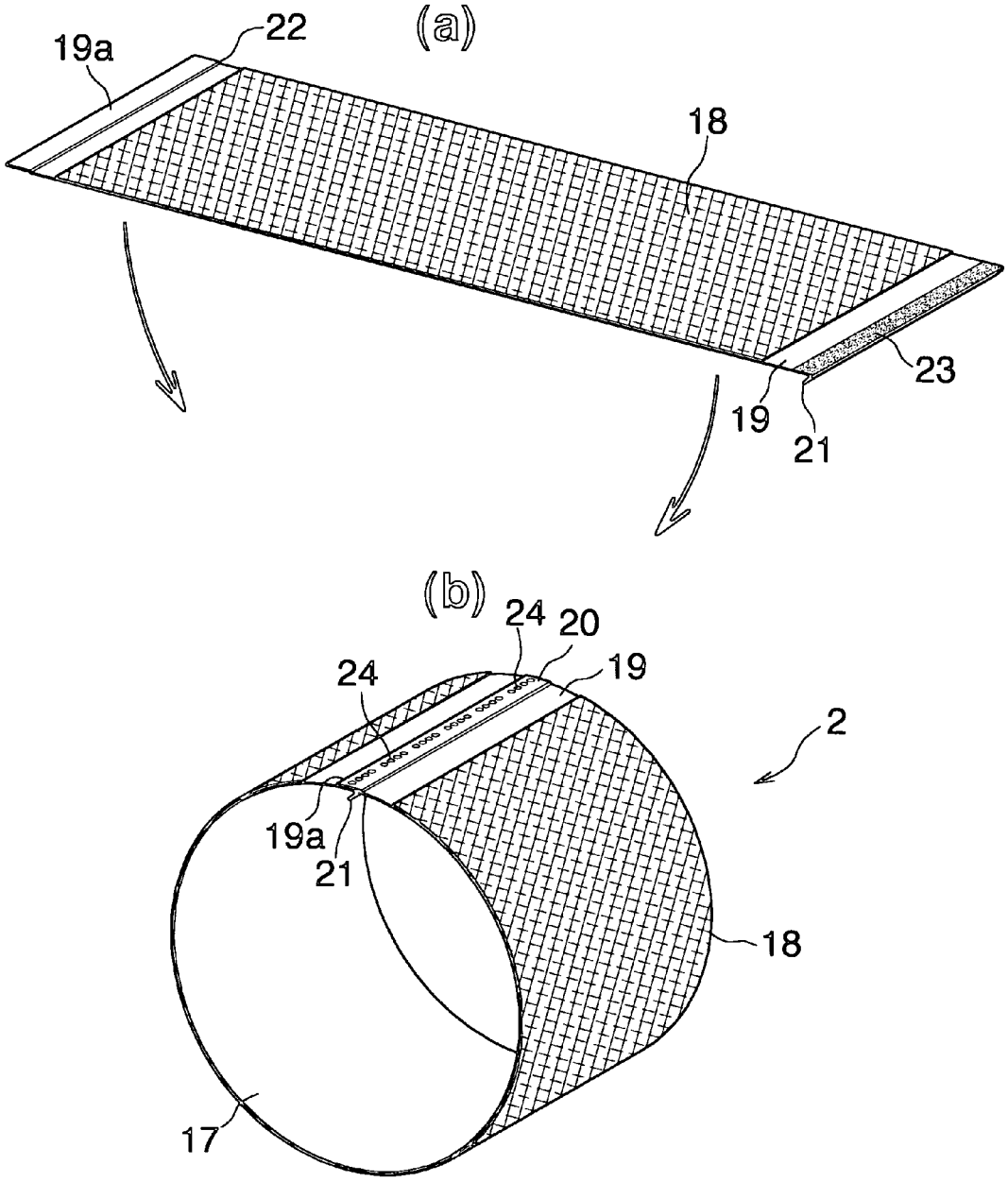
FIG. 4 is a pair of perspective views showing a machine plate and a process of manufacturing the machine plate.
Figure 5:
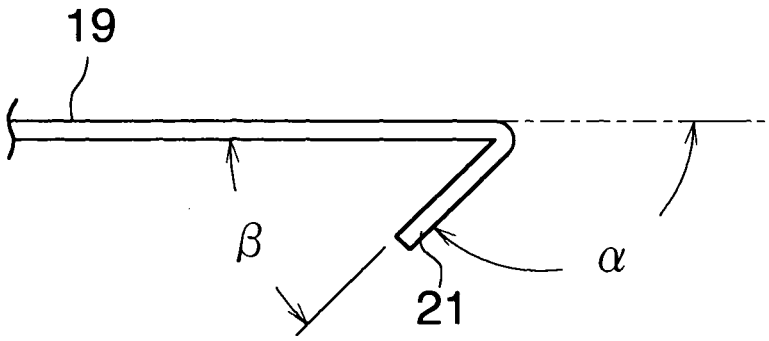
FIG. 5 is a side view showing, on an enlarged scale, a portion of a sheet as viewed before formation of the machine plate of FIG. 4.

FIG. 1 is a vertical sectional view of a machine-plate mounting device 3 which is attached to a machine-plate drive shaft 1 of the printer and on which a machine plate 2 is mounted. FIG. 2 is a vertical sectional view showing, on an enlarged scale, a portion of the machine-plate mounting device 3 and a portion of the machine plate 2 before being attached thereto. FIG. 3 is a sectional view (transverse sectional view) taken along line III-III of FIG. 1. FIG. 4 is a pair of perspective views showing the machine plate 2 and a process of manufacturing the machine plate 2. FIG. 5 is a side view showing, on an enlarged scale, a portion of a sheet as viewed before formation of the machine plate 2 of FIG. 4. In the following description, the upper and lower sides of FIG. 1 will be referred to as "upper" and "lower," respectively. The left-hand and right-hand sides of FIG. 1 will be referred to as "front" and "rear," respectively. The left-hand and right-hand sides as viewed from the front toward the rear will be referred to as "left" and "right," respectively.

In FIG. 1, reference numeral 4 denotes a thick-plate-like machine frame of a printer which extends in the vertical direction and in the left-right direction; and 5 denotes a bearing housing provided on the rear side of the machine frame 4. A front portion of the machine-plate drive shaft 1 is rotatably supported by the bearing housing 5, and a rear portion of the machine-plate drive shaft 1 is rotatably supported by an unillustrated bearing housing. The shaft 1 is rotated in a predetermined direction (in this example, clockwise as viewed from the front side) at a predetermined speed by known drive means. A portion of the shaft 1 near the front end thereof passes through a circular hole 6 formed in the machine frame 4 and projects frontward from the machine frame 4. An oil seal 7 is provided along the inner circumferential wall of the hole 6 so as to establish sealing against the shaft 1. A taper portion 1*a* is formed on a front end portion of the shaft 1 located on the front side of the machine frame 4 such that the diameter of the taper portion decreases toward the distal end thereof. A short cylindrical portion 8 is formed on the front surface of the machine frame 4 concentrically with the hole 6 such that the cylindrical portion 8 projects forward from the front surface and is located radially outward of the hole 6.

The machine-plate mounting device 3 is removably fixed on the shaft taper portion 1*a*.

The machine-plate mounting device 3 includes a machine-plate cylinder section 9 to be fixed on the shaft taper portion 1*a*. The machine-plate cylinder section 9 is composed of an outer cylindrical portion 9*a* concentric with the shaft 1; an inner tapered tubular portion 9*b* which is concentric with the outer cylindrical portion 9*a* and whose diameter decreases toward the front end thereof; a front end wall 9*c* which connects together front end portions of the cylindrical portion 9*a* and the tapered tubular portion 9*b*; and a rear end wall 9*d* which connects together rear end portions of the cylindrical portion 9*a* and the tapered tubular portion 9*b*. An annular space surrounded by these portions and walls serves an air chamber 10. The machine-plate cylinder section 9 is fitted onto the shaft taper portion 1*a* such that the inner circumferential surface of the tapered tubular portion 9*b* comes into close contact with the outer circumferential surface of the shaft taper portion 1*a*, and is fixed thereto by use of an unillustrated suitable means. The machine-plate cylinder section 9 is formed of a proper magnetic or nonmagnetic metal. In this example, SS steel, which is a general structural steel, is used to form the machine-plate cylinder section 9. Further, the cylindrical portion 9*a*, the tapered tubular portion 9*b*, the front end wall 9*c*, and the rear end wall 9*d* are formed to have a relatively large wall thickness from the viewpoint of strength.

A rear portion of the cylindrical portion 9*a* extends rearward beyond the rear end wall 9*d* to a point located radially outward of the short cylindrical portion 8 of the machine frame 4. An oil seal 11 is provided along the inner circumferential surface of a rear end portion of the cylindrical portion 9*a* so as to establish sealing against the short cylindrical portion 8, whereby an annular closed space 12 is formed between the rear end wall 9*d* and the machine frame 4. A plurality of communication holes 13 are formed in the rear end wall 9*d* so as to establish communication between the air chamber 10 and the closed space 12.

A plurality of air discharge holes 14 are formed in the cylindrical portion 9*a* at equal intervals in the circumferential direction, at a plurality of locations with respect to the front-rear direction, the locations facing the air chamber 10 (in this example, two locations; i.e., a location at the front end and a location near the rear end).

An air passage 16 is formed in the machine frame 4 of the printer. The air passage 16 is connected to a compressed air source 15, and communicates with the closed space 12. The compressed air source 15, the air passage 16, the closed space 12, and the communication hole 13 constitute air supply means.

As shown in detail in FIG. 2, a portion A of the cylindrical portion 9*a* extending rearward from a position located slightly rearward of the front-side discharge hole 14 has a fixed outer diameter. The outer diameter of a portion B of the cylindrical portion 9*a* between the front end of the portion A and a position located frontward of the discharge hole 14 decreases toward the front end of the portion B. The outer diameter of a portion C of the cylindrical portion 9*a* located on the front side of the portion B decreases further toward the front end of the portion C. In this example, the outer diameter of the portion A of the cylindrical portion 9*a* is 220 mm, and the difference in outer diameter between the portion A and the front end of the portion B is about 0.2 mm.

The machine plate 2 assumes a cylindrical shape. The machine plate 2 is composed of a cylindrical machine-plate body 17 and a forme area 18.

The cylindrical machine-plate body 17 is formed from a rectangular sheet 19 of an elastic material as shown in FIG. 4(*a*). The sheet 19 is formed into a cylindrical shape with its opposite end portions superposed on each other and joined together, thereby forming the cylindrical machine-plate body 17. No limitation is imposed on the thickness of the sheet 19, so long as the sheet can be formed into a cylindrical shape and can maintain the cylindrical shape by means of its elastic force. In this example, the thickness is about 0.24 mm. The inner diameter of the machine-plate body 17 is slightly smaller than the outer diameter of the portion A of the cylindrical portion 9*a* of the machine-plate cylinder section 9, and approximately equal to the outer diameter of a portion of the portion B located immediately rearward of the discharge hole 14. The machine-plate body 17 is formed from an appropriate magnetic or nonmagnetic metal. In this example, SS steel, which is a general structural steel, is used to form the machine-plate body 17. A joining means for the sheet 19 is arbitrary. In this example, an adhesive and spot welding are used as the joining means.

The forme area 18 is provided at a predetermined portion of the outer circumferential surface of the machine-plate body 17 excluding the joint portion 20.

An end portion of the sheet 19 located on the inner side of the joint portion 20 is bent inward, thereby forming the engagement portion 21. In FIG. 5, an angle $\alpha$ at which the engagement portion 21 is actually bent from a flat state of the sheet 19 represented by the chain line is called the bending angle, and an angle $\beta$ between the engagement portion 21 and an adjacent portion of the sheet 19 is called the sheet-engagement-portion angle. The bending angle $\alpha$ is preferably greater than 90 degrees (the sheet-engagement-portion angle $\beta$ is less than 90 degrees), more preferably 125 degrees to 145 degrees inclusive (the sheet-engagement-portion angle $\beta$ is 55 degrees to 35 degrees inclusive), most preferably 135 degrees (the sheet-engagement-portion angle $\beta$ is 45 degrees). In this example, the bending angle $\alpha$ is about 135 degrees, and the sheet-engagement-portion angle $\beta$ is about 45 degrees. As shown in detail in FIG. 3, a step portion 22 is formed between an end portion 19*a* of the sheet 19 located on the outer side of the joint portion 20 of the machine plate 2 and a center-side portion of the sheet 19, and the inner diameter of the end portion 19*a* is greater than that of the remaining portion of the sheet 19. The size of the step of the step portion 22 is equal to or less than the thickness of the sheet 19.

A method of manufacturing the machine plate 2 is arbitrary. Next, an example method of manufacturing the machine plate 2 will be described with reference to FIG. 4.

First, as shown in FIG. 4(*a*), the engagement portion 21 is formed at an end portion of the rectangular sheet 19; the step portion 22 is formed at the other end thereof; and the forme portion 18 is formed at a predetermined portion of the sheet 19 excluding opposite end portions. Then, an appropriate adhesive 23 is applied to the surface of an end portion of the sheet 19 associated with the engagement portion 21, the surface being located on a side opposite the engagement portion 21. Next, as shown in FIG. 4(*b*), the sheet 19 is formed into a cylindrical shape; an opposite end portion 19*a* of the sheet 19 is externally overlaid on the adhesive 23 for joining; and joining of the joint portion 20 is enhanced by spot welding. In FIG. 4(*b*), reference numeral 24 denotes spot-welded zones. Forming a forme in the forme area 28; i.e., a forme-making process, may be performed on the forme area 18 of the sheet 19 of FIG. 4(*a*) or on the forme area 18 of the cylindrical machine plate 2 of FIG. 4(*b*).

As shown in FIG. 3, a groove 25 for circumferential positioning into which the engagement portion 21 of the machine plate 2 is fitted is formed in the outer circumference of the cylindrical portion 9*a* of the machine-plate cylinder section 9 over the entire length thereof. The angle β between the groove 25 and the outer circumferential surface of the cylindrical portion 9*a* is equal to the sheet-engagement-portion angle β of the engagement portion 21 of the machine plate 2. The groove 25 is formed such that its bottom portion 25*a* is located rearward of its opening portion 25*b* with respect to the rotational direction of the machine-plate cylinder section 9 (the direction indicated by an arrow R in FIG. 3).

As shown in FIG. 1, an annular stopper 26 for axial positioning is fixed to an outer circumferential portion of the rear end surface of the cylindrical portion 9*a* of the machine-plate cylinder section 9 in such a manner as to slightly project radially outward beyond the outer circumferential surface of the cylindrical portion 9*a*.

When the machine plate 2 is to be mounted on the machine-plate cylinder section 9, compressed air is supplied to the air chamber 10 of the machine-plate cylinder section 9. When compressed air is supplied to the air chamber 10, the air flows outward from the air discharge holes 14 on the outer circumferential surface of the cylindrical portion 9*a*. When the cylindrical machine plate 2 is fitted onto the outer circumferential surface of the machine-plate cylinder section 9 while the engagement 21 is fitted into the groove 25 in this state, the machine plate 2 expands in the radial direction due to the pressure of the air discharged from the air discharge holes 14, whereby the inner diameter of the machine plate 2 becomes larger than the outer diameter of the machine-plate cylinder section 9, and the machine plate 2 can be readily fitted onto the outer circumference of the machine-plate cylinder section 9. When the machine plate 2 comes into engagement with the stopper 26 and stops, the supply of compressed air to the air chamber 10 is stopped. As a result, the machine plate 2 contracts and comes into close contact with the outer circumferential surface of the cylindrical portion 9*a*, whereby the machine plate 2 is fixed in a press-fitted state at a position where the machine plate 2 comes into engagement with the stopper 26. At that time, in relation to the machine-plate cylinder section 9, the machine plate 2 is accurately positioned in the circumferential direction by the groove 25 and in the axial direction by the stopper 26.

At the time of printing, the machine-plate cylinder section 9 is rotated in a state where the machine plate 2 is fixed to the machine-plate cylinder section 9 as described above. At that time, the distal end of the engagement portion 21 of the machine plate 2 faces rearward with respect to the rotational direction R, whereby the engagement portion 21 bites into the groove 25, and the position of the machine plate 2 is free from deviation.

When the machine plate 2 mounted on the machine-plate cylinder section 9 as described above is to be removed from the machine-plate cylinder section 9, compressed air is supplied to the air chamber 10 of the machine-plate cylinder section 9. When air is supplied to the air chamber 10 and is caused to flow out of the discharge holes 14, the machine plate 2 expands in the radial direction due to the pressure of the air, whereby the inner diameter of the machine plate 2 becomes larger than the outer diameter of the machine-plate cylinder section 9, and the machine plate 2 can be readily removed from the machine-plate cylinder section 9.

The overall and component-level configurations of the printer, the machine-plate mounting device 3, and the machine plate 2 are not limited to those of the above-described embodiments and may be modified as appropriate.

INDUSTRIAL APPLICABILITY

The present invention is suitably applied to printer machine plates and printers. When a printer machine plate and a printer according to the present invention are used, a cylindrical machine plate can be readily and accurately attached to a machine-plate cylinder section fixedly provided on a machine-plate drive shaft of the printer. Further, the cylindrical machine plate can be readily removed from the machine-plate cylinder section.

The invention claimed is:

1. A printer characterized by comprising a machine-plate mounting device on which a cylindrical machine plate is mounted, wherein the machine plate is configured such that a rectangular sheet of an elastic material is formed into a cylindrical shape with opposite end portions of the sheet superposed on each other and joined together to form a joint portion whereby a cylindrical machine-plate body is formed; an end portion of the sheet located on the inner side of the joint portion is bent inward whereby an engagement portion is formed; and a forme area is provided at a predetermined portion of the outer circumferential surface of the machine-plate body excluding the joint portion;

the machine-plate mounting device comprises a machine-plate cylinder section which is fixedly provided on a taper portion on a front end of a machine-plate drive shaft from a front-end side of the machine-plate drive shaft, wherein the machine-plate cylinder section has, on the outer circumference, a groove for circumferential positioning into which the engagement portion of the machine plate is fitted from the front-end side of the machine-plate drive shaft, and a stopper for axial positioning with which an end portion of the machine plate comes into contact, and the machine-plate cylinder section is composed of an outer cylindrical portion concentric with the shaft;

an inner tapered tubular portion which is concentric with the outer cylindrical portion and whose diameter decreases toward the front-end thereof;

a front end wall which connects together front end portions of the outer cylindrical portion and the inner tapered tubular portion; and a rear end wall which connects together rear end portions of the outer cylindrical portion and the inner tapered tubular portion;

wherein the machine-plate cylinder section is fitted onto the taper portion of the machine-plate drive shaft such that the inner circumferential surface of the inner tapered tubular portion comes into close contact with the outer circumferential surface of the taper portion and fixed thereto; and the outer diameter of a front end portion of the machine-plate cylinder section decreases toward the distal end thereof;

wherein the machine-plate cylinder section has an air chamber which is formed by the outer cylindrical portion, the inner tapered tubular portion, the front end wall and the rear and to which compressed end wall of the machine-plate cylinder section air is supplied from air supply means;

an annular closed space is formed between the rear end wall and a machine frame of the printer;

a plurality of communication holes are formed in the rear end wall so as to establish communication between the air chamber and the annular closed portion; and air discharge holes, communicating with the air chamber, are formed on the outer circumferential surface of the machine-plate cylinder section, including a portion having a decreased outer diameter, at a plurality of locations in the axial direction and the circumferential direction.

2. A printer according to claim 1, wherein the bending angle of the engagement portion of the machine plate is greater than 90 degrees; and the machine-plate cylinder section is rotated in such a direction that the end portion of the sheet which constitutes the machine-plate body, the end portion having the engagement portion, is located on the front side with respect to the rotational direction.

3. A printer according to claim 1, wherein the air discharge holes are formed in the outer cylindrical portion of the machine-plate cylinder section at equal intervals in the circumferential direction, at least at the front end and at near the rear end facing the air chamber; and a first portion of the outer cylindrical portion extending rearward from a position located rearward of a front-end discharge hole has a fixed diameter, the outer diameter of a second portion of the outer cylindrical portion between the front end of the first portion and a position located frontward of the front-end discharge hole decreases toward the front end of the second portion, the outer diameter of a third portion of the outer cylindrical portion located on the front side of the second portion decreases further toward the front end of the third portion.

* * * * *